United States Patent [19]

Morita et al.

[11] 4,086,873

[45] May 2, 1978

[54] ELECTROPHOTOGRAPHIC DEVELOPING DEVICE INCORPORATING A DEVELOPING ELECTRODE HAVING AN INSULATION LAYER ON ITS SURFACE

[75] Inventors: Sizuo Morita; Hiroshi Thuchiya; Kiyoshi Kimura, all of Hachioji, Japan

[73] Assignee: Konishiroku Photo Industry Co., Ltd., Tokyo, Japan

[21] Appl. No.: 768,279

[22] Filed: Feb. 14, 1977

Related U.S. Application Data

[63] Continuation of Ser. No. 593,968, Jul. 8, 1975, abandoned.

[30] Foreign Application Priority Data

Jul. 9, 1974 Japan ..... 49-78429

[51] Int. Cl.[2] ..... G03G 15/09

[52] U.S. Cl. ..... 118/658; 96/1 R; 118/651; 118/648

[58] Field of Search ..... 118/651, 652, 653, 648, 118/657, 658, 647; 427/18, 21; 355/3 DD; 96/1 R

[56] References Cited

U.S. PATENT DOCUMENTS

| | | | |
|---|---|---|---|
| 3,257,224 | 6/1966 | Jons et al. | 118/653 |
| 3,552,355 | 1/1971 | Flint | 118/657 |
| 3,647,293 | 3/1972 | Queener | 118/652 |
| 3,669,072 | 6/1972 | Reynolds et al. | 118/657 |
| 3,674,532 | 7/1972 | Morse | 118/657 |
| 3,739,749 | 6/1973 | Kangas et al. | 118/658 |
| 3,741,156 | 6/1973 | Jo et al. | 118/648 |
| 3,754,526 | 8/1973 | Caudill | 118/658 |
| 3,950,089 | 4/1976 | Fraser et al. | 118/658 X |
| 3,990,394 | 11/1976 | Katakuna | 118/658 |

*Primary Examiner*—Louis K. Rimrodt
*Assistant Examiner*—Andrew M. Falik
*Attorney, Agent, or Firm*—Bierman & Bierman

[57] ABSTRACT

This application discloses an electrophotographic developing device having an electrode located at the developing station oppositely to an electrostatic latent image bearing body wherein said electrostatic latent image is developed with a developer that consists of an electrically conductive carrier and toner. Development occurs while applying a bias voltage between said body and said electrode which has an insulation layer on its surface.

5 Claims, 5 Drawing Figures

ELECTROPHOTOGRAPHIC DEVELOPING DEVICE INCORPORATING A DEVELOPING ELECTRODE HAVING AN INSULATION LAYER ON ITS SURFACE

This application is a continuation of Application Ser. No. 593,968 filed July 8, 1975, now abandoned, and which claims the priority of Japanese 78429/1974, filed July 9, 1974.

The present invention is related to an electrophotographic developing device for use in the field of electrophotographic copying.

According to a conventional electrophotographic copying method, in general, the electrostatic latent image is formed by a conventional manner on a photoconductive insulation layer (hereafter called photosensitive layer) which forms a photosensitive plate, and then a developer composed of a toner and a carrier is brought into contact with said latent image to develop it into visible image.

One of the problems of such a developing step is, as well known, "fog". This is a phenomenon in which an entire copy is fouled as a result of the fact that the toner has electrostatically adhered onto the light-exposed area of the photosensitive layer due to the residual charge. In order to give a solution to the problem of the fog, there has been proposed a method of applying a biasing voltage. According to the method, a d-c voltage of nearly the same magnitude as the residual potential at the non-image region on said photosensitive plate and of the same polarity is applied to an electrode provided on the side of the developing device at the time of conducting developing, and either a conductive plate provided on the back side of said photosensitive plate that will serve as an opposing electrode or a conductive layer which is one of the elements for constituting the photosensitive plate is grounded to establish an electric field across said two electrodes, and while the developer is exhibiting developing action as mentioned in the foregoing, the repulsive action is utilized between the polarity of charge on the non-image region of said photosensitive plate and the polarity of the applied biasing voltage to prevent the toner from being adhered onto said non-image region. In this way, it is true that the method of applying a biasing voltage is surely effective for the purpose of reducing "fog", but, on the contrary, imposes a new problem. The problem does not reside on the method of applying a biasing voltage, but is restricted mainly to local fog (often called "banding" as it appears in the form of bands) caused by the combination of the form of carrier, kinds of photosensitive plate, etc.

Figure 1:
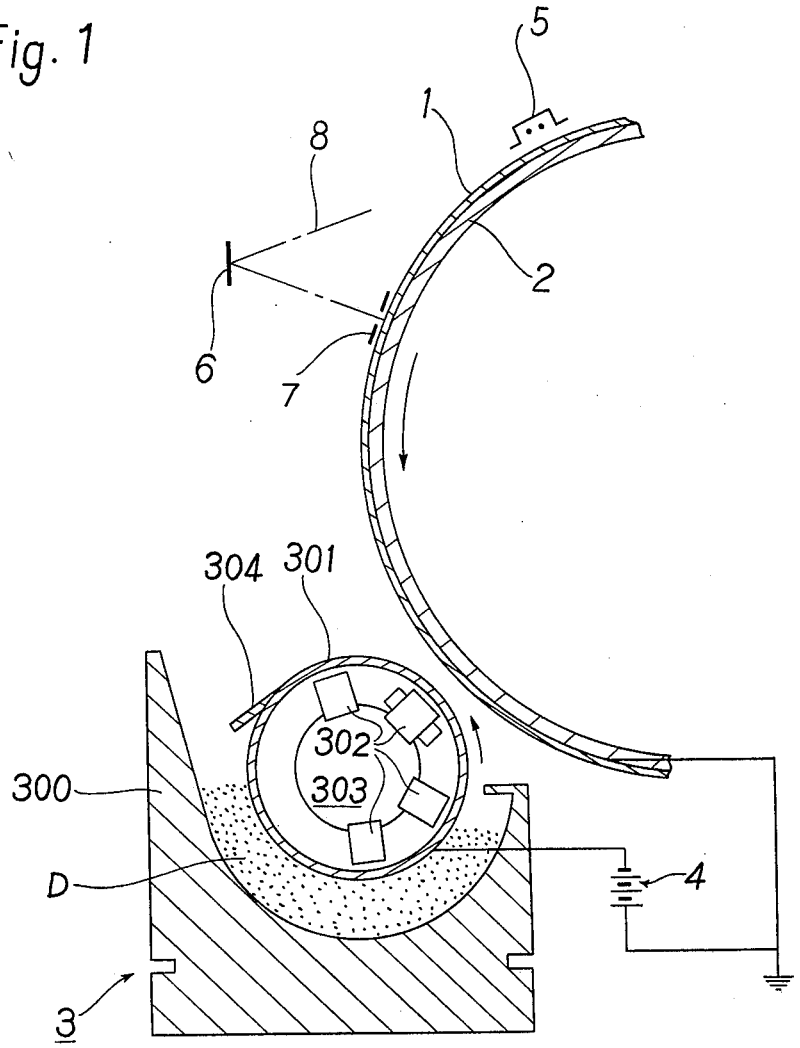
Figure 2:
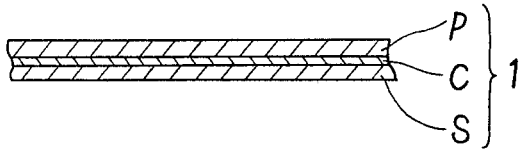
Figure 3:
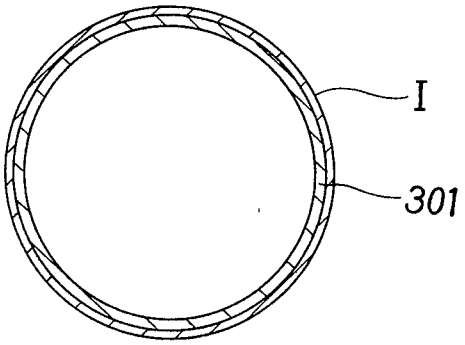
Figure 4:
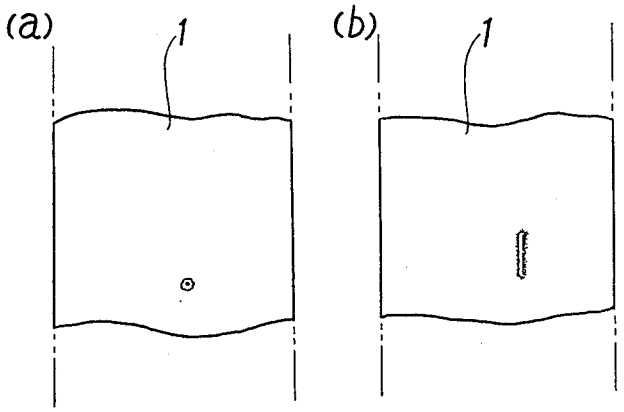
Figure 5:
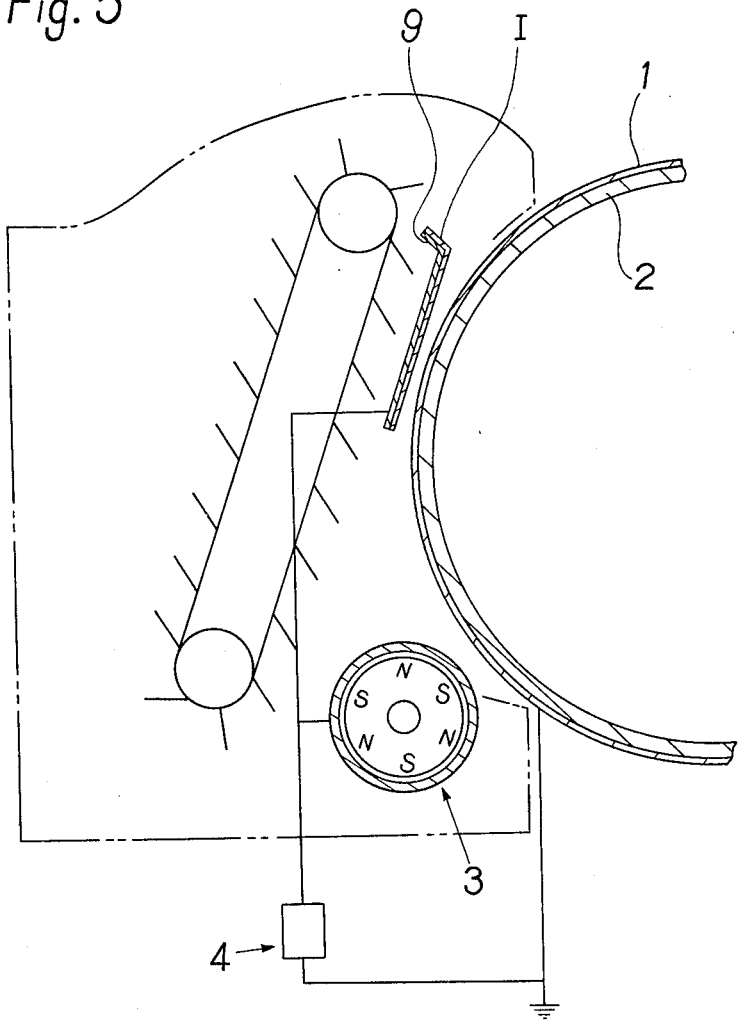

FIG. 1 is a schematic diagram showing a magnetic brush developing part in a conventional electrophotographic copying apparatus, FIG. 2 is a cross-sectional view showing a structure of a photosensitive plate, FIG. 3 is a cross-sectional view of a cylindrical member for carrying a developer according to the present invention, FIG. 4 is an enlarged view of dot fog restrained by the present invention, and FIG. 5 is a diagram of another embodiment of the present invention which combines means of magnetic brush developing and means of cascade developing.

The manner in which the problem of band-like fog is treated is explained below in connection with the apparatus illustrated in FIG. 1 in which a positive-to-positive copier is partially shown. FIG. 1 is a schematic diagram of the developing portions. In the drawing, the reference numeral 1 represents a photosensitive plate placed closely on an electric conductive drum 2. The photosensitive plate 1 virtually used is a rolled photosensitive plate composed of an electric conductive layer (aluminum foil) C, a support (paper) S, and a photosensitive layer P which is prepared by mixing and kneading a photoconductive zinc oxide fine powder together with a binder such as silicone resin, acetate resin or polystyrole, as schematically shown in FIG. 2. The photosensitive plate is placed appropriately on said drum 2 to cover about three-fourths of the surface of said drum 2. But the drawing here shows it in a simplified manner. The following description will illustrate the invention on the assumption of using a photosensitive plate composed of said zinc oxide-resin dispersion system, unless otherwise mentioned.

Furthermore, the conductive layer C of said photosensitive plate 1 is grounded, and said drum 2 is linked to an appropriate drive mechanism to be rotatable as indicated by an arrow. The reference numeral 3 is a developing device of the magnetic brush type which is installed along the moving locus of said photosensitive plate 1. The reference numeral 300 stands for a frame having a recess to store a developer D composed of a toner and magnetic particles, which particles are of electrically conductive material, 301 stands for a non-magnetic and electrically conductive cylindrical member (the unit shown in the drawing is usually called a sleeve) which is so provided on a side board (not shown) of said frame 300 as to rotate in the direction of an arrow, and 302 is a fixed permanent magnet assembly provided along the inner periphery of said cylindrical member 301 adjacent the inner surface thereof and is firmly mounted on a core 303. The permanent magnet assembly 302 consists of magnets having alternatingly different poles and spanning over a certain range required for developing. Here, said permanent magnet assembly 302 may be arrayed over an entire periphery of the core 303 and the endless member may be fixed, just contrary to the aforementioned example, to rotate said permanent magnet 302. These two units may be rotated in the opposite directions with respect to each other. Further, the magnet may be composed of a single unit in place of an aggregate of individual magnet pieces. Where the magnet is composed of a single unit, such a unit may have an array of alternatingly different polarities. Where the magnet is composed of an aggregate of magnet pieces, the neighboring magnet pieces may not completely be brought into contact to one another. Moreover, the array of magnetic poles may most preferably be an alternating array of N pole and S pole. But depending on situations, magnets of the same polarity may be arrayed in a series in a plurality of pieces. The reference numeral 304 is a scraper. Referring to the aforementioned setup, said conductive endless member 301 is connected to the terminal on the negative side of a bias-voltage power supply 4; said endless member 301 serves as an electrode for reducing fog. As mentioned above, the conductive layer C of said photosensitive plate 1 serves as an opposing electrode with respect to said electrode (cylindrical member 301); therefore, when put into practice, there will be formed an electric field between said two electrodes. The reference numeral 5 represents a charging electrode for charging said photosensitive plate 1 of an n-type semiconductor, 6 is a mirror which leads light reflected from the original (not shown) through an appropriate optical system to a moving photosensitive plate 1, 7 is a slit, and 8 represents a path of reflected light. Being constructed as mentioned above, if a copying operation is started, the charging electrode 5 imparts uniform charge to the moving photosensitive plate 1, and then the reflected light 8 irradiates said photosensitive plate 1 to successively form electrostatic latent image corresponding to the image of the original. The developer D is then allowed to be absorbed by said cylindrical member 301 and rubbed onto said photosensitive plate 1 to accomplish developing. However, the photosensitive layer P of said photosensitive plate 1 is formed by coating, and easily gets scarred even by scratching, unlike the evaporation coated selenium photosensitive plate. Further, the magnetic particles used as a carrier of a developing agent have many needle-like projections and tend to bite into the photosensitive layer P getting into the conductive layer C. If the particles bite into the conductive layer C, then the potential gradient formed between said member 301 and the surface of the photosensitive plate 1 becomes zero (called bias drop). In other words, a short-circuit is formed along the member 301—developer D—bitten magnetic particles—conductive layer C. Under such a condition, the effects of biasing voltage are lost. In addition, since the developer D which contributes to developing is in contact with said photosensitive plate 1 maintaining some width, said bias drop gives adverse effects not only to the photosensitive plate into which are biting said magnetic particles but also to the entire area to which the developer is contacting, and results in band-like fog (often called "banding") on said photosensitive plate 1. Further, even when the depth of biting of said magnetic particles into said photosensitive layer is not so deep, or when said magnetic particles are just contacting to said conductive layer, whereby the potential is not dropped down to zero between said endless member and the photosensitive plate (i.e. between the surface of the developing agent and the surface of the photosensitive plate), there is also developed band-like fog due to the potential drop of the developing agent.

The phenomenon of fog will easily appear when the photosensitive plate has coating irregularities due to bubbles in the photosensitive layer (especially pin holes of the support of a double-layer structure without having conductive layer), or when the photosensitive plate has areas of low break-down voltage due to irregularities of the coating thickness.

The present invention was proposed to eliminate the aforementioned drawbacks. And the object of the invention is to provide an electrophotographic developing device having an electrode located at the developing station oppositely to an electrostatic latent image bearing body wherein said electrostatic latent image is developed with a developer consisting of an electrically conductive carrier and toner while applying a biasing voltage between said surface and said electrode characterized in that said electrode is provided on its surface with an insulation layer.

FIG. 3 shows an embodiment of the present invention, in which the same reference numerals as those of FIG. 1 represent the same members, and their description is omitted here.

The symbol I is a high-insulation layer obtained by treating a conductor (cylindrical member) 301 made of pure aluminum or aluminum alloy (such as aluminum-manganese alloy, aluminum-magnesium alloy, or duralumin) with alumite, and has a volume specific resistance nearly equal to, or a little smaller than, that of the photosensitive plate (photoconductive materials generally used being composed of zinc oxide, may largely have a volume specific resistivity of about $10^{12}$ to $10^{15}$ ohms per centimeter). The resistivity should preferably be in the range of $10^{8}$ to $10^{15}$ ohms per centimeter. And in practice, the resistivity may be appropriately selected in relation to the photoconductive material. The material and high-insulation layer of said member 301 should not be limited to the aforesaid examples only, but may be, for example, a brass and those of which metallic surface is oxidation treated, and may further be coated with silicon. Such materials may also be coated on their metallic surfaces with a synthetic resin such as silicone resin, urea resin, melamine resin, and polyvinylbutylal resin, or may be electroplated.

Of course, the shape of such an cylindrical member may take a circular shape as well as of a belt shape. It has been observed that by providing a high-insulation coating on the surface of the member 301 shown in FIG. 1 as mentioned above, and by conducting the developing in the same manner as mentioned above, the portions to which the magnetic particles have plunged appear as fine black dots and ring-like fog faintly encircling such dots (see FIG. 4). Further, since the fog is so small that the picture quality is not impaired at all. Another experiment has also proved the fact that when a high-insulation coating is provided, such band-like fog did not appear, and fog appeared only on defective portions of the photosensitive plate.

In other words, where a photosensitive plate having a scar cut by a razor blade is used to effect developing all in the same manner as mentioned above, the fog appeared only on said scarred portion and neighboring portion (see FIG. 4) but never appeared in a band form.

According to the developing device of the present invention mentioned in the foregoing, it is possible not only to remove the band-like fog but also to expect effects mentioned below. That is, since the electric field is established between the photosensitive plate and the cylindrical member having a resistivity near to the volume specific restivity of said photosensitive plate via a developer therebetween, it is possible to easily control the biasing current flowing to said photosensitive plate as compared to earlier methods which employ a conductive endless member, and eventually it is possible to inhibit deterioration of the photosensitive plate that will be caused by increased number of copy-taking operation. Further, the U.S. Pat. No. 3,647,293 discloses a developing-sweeping method which combines means of said magnetic brush developing and means of cascade developing. The method disclosed in said U.S. patent is a two-cycle reproduction method, in which developing is effected based on a magnetic brush developing method in the first rotation of the photosensitive plate, and in the second rotation, the toner powder remaining on said photosensitive plate is sweeped away by the cascade method; a piece of copy is obtained for every two rotation of the photosensitive plate. Therefore, such a method is not, in a pure sense, a combination of two developing methods. But such a combination of two developing methods is very advantageous to meet the demand of high-speed large-quantity copy taking. Even in such a case, it is essential to provide a means of applying biasing voltage to remove fog, which was mentioned at the beginning of the detailed description of the invention.

Therefore, it is possible to obtain the same effects as mentioned in the foregoing by using a photosensitive plate having a soft surface which is composed of coating on a support a cadmium sulfide or a zinc oxide fine powder which is admixed and kneaded together with an insulative resin binder, using magnetic particles having needle-like projections which are simply pulverized as a carrier, providing a high-insulation coating on the surface of a conductive endless member which constitutes a means of magnetic brush developing, and by applying a biasing voltage by the method shown in FIG. 1. Furthermore, as required, it is also possible to form an electric field between a conductive plate 9 and the photosensitive plate by disposing the conductive plate 9 to oppose to the photosensitive plate on a part of the developer flow path in the cascade method, and by providing a high-insulation layer I on the conductive plate 9 (see FIG. 5). In any event, the essential matter of the present invention is to remove band-like fog that may develop on the photosensitive plate at the time of developing by providing a high-insulation layer on the surface of a member which carries an electric conductive developer, and based on relations among the photosensitive plate having soft-surface, magnetic particles (carrier) having needle-like projections and biasing voltage, as mentioned already.

It should, therefore, be understood that the present invention is not limited to the aforesaid embodiments only, but may be modified and applied without departing from the scope of the claim.

What we claim is:

1. An electrophotographic developing apparatus comprising a photosensitive plate having a conductive layer thereon and a soft photoconductive layer on said conductive layer, a magnetic brush positioned adjacent to the surface of said photoconductive layer, said magnetic brush comprising an electrode and a highly insulating material covering said electrode and disposed opposite and adjacent to said photoconductive layer, a developer/toner including suspended magnetic particles, means forming part of said magnetic brush for carrying said developer/toner onto said photoconductive layer, and means for preventing injury to said soft photoconductive layer by said suspended magnetic particles, said last means comprising means for applying a biasing voltage between said electrode and said photosensitive plate for reacting on said particles, said voltage being of sufficient strength to prevent penetration and/or scratching of said photoconductive layer while still permitting deposition of said developer/toner onto said photoconductive layer.

2. The apparatus according to claim 1 wherein said electrode is cylindrical and wherein magnetic brush has a plurality of magnets within said cylindrical electrode, said magnets and cylindrical electrode being relatively rotatable with respect to each other for continuously supplying developer to said photoconductive layer.

3. The apparatus according to claim 1 wherein said insulating material and said photoconductive plate have volume specific resistances substantially equal to each other.

4. The apparatus according to claim 1 wherein said photoconductive layer comprises an insulative resin binder containing a compound selected from the group consisting of cadmium sulfide and zinc oxide.

5. The apparatus according to claim 1 further comprising a conveyor for carrying and supplying developer to said photoconductive layer, said conveyor being spaced from said magnetic brush, a second electrode adjacent said conveyor and said photoconductive layer, said second electrode having an insulating material thereon facing said photoconductive layer, and means for applying a biasing voltage between said second electrode and said photosensitive plate.

* * * * *